US009126402B2

(12) United States Patent
Tamura

(10) Patent No.: US 9,126,402 B2
(45) Date of Patent: Sep. 8, 2015

(54) INK JET APPARATUS AND METHOD FOR CONTROLLING INK JET APPARATUS

(71) Applicant: CANON KABUSHIKI KAISHA, Tokyo (JP)

(72) Inventor: Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/454,151

(22) Filed: Aug. 7, 2014

(65) Prior Publication Data

US 2015/0062211 A1 Mar. 5, 2015

(30) Foreign Application Priority Data

Sep. 4, 2013 (JP) ..... 2013-182898

(51) Int. Cl.
*B41J 29/38* (2006.01)
*B41J 2/045* (2006.01)

(52) U.S. Cl.
CPC ..... *B41J 2/0455* (2013.01); *B41J 2/04581* (2013.01)

(58) Field of Classification Search
CPC .. B41J 2/04541; B41J 2/0458; B41J 2/04581; B41J 2/04588; B41J 2/04543
USPC ..... 347/9, 19
See application file for complete search history.

(56) References Cited

U.S. PATENT DOCUMENTS

| | | | | |
|---|---|---|---|---|
| 6,802,583 | B2 | 10/2004 | Tamura | |
| 6,969,135 | B2 | 11/2005 | Tamura | |
| 7,429,093 | B2 | 9/2008 | Shinkawa | |
| 2005/0122360 | A1 * | 6/2005 | Sakagami et al. | 347/19 |
| 2005/0212845 | A1 * | 9/2005 | Shinkawa | 347/19 |

FOREIGN PATENT DOCUMENTS

| | | | |
|---|---|---|---|
| JP | 2005-305992 | A | 11/2005 |
| WO | 2004/076180 | A1 | 9/2004 |

* cited by examiner

*Primary Examiner* — Manish S Shah
*Assistant Examiner* — Yaovi Ameh
(74) *Attorney, Agent, or Firm* — Fitzpatrick, Cella, Harper & Scinto

(57) ABSTRACT

An ink jet apparatus includes a plurality of actuators that discharge a liquid from a discharge port according to a driving signal input to an input terminal; a driving selector that outputs a drive switch control signal; a plurality of drive switches that connect or disconnect the input terminal of the actuator and a driving signal source according to the drive switch control signal for the actuator, and allow the driving signal to pass therethrough and input the driving signal to the input terminal when the input terminal and the driving signal source are connected; a detection circuit that detects a voltage of the input terminal when being connected to the input terminal; and a plurality of detection switches that connect or disconnect the input terminal of the actuator and the detection circuit on the basis of the drive switch control signal or the driving signal passed through the drive switch.

9 Claims, 8 Drawing Sheets

INK JET APPARATUS AND METHOD FOR CONTROLLING INK JET APPARATUS

BACKGROUND OF THE INVENTION

1. Field of the Invention

The present invention relates to an ink jet apparatus and a method for controlling the ink jet apparatus.

2. Description of the Related Art

Ink jet apparatuses that form an image on an object to be printed on, using an ink jet head discharging a liquid from a plurality of discharge ports, have been widely used. The ink jet apparatuses change the volume of a pressure chamber communicating with a discharge port to thereby discharge the liquid stored in the pressure chamber from the discharge port. As a type in which the volume of the pressure chamber is changed, there is a type using an actuator that displaces a wall surface of the pressure chamber. A type using a piezoelectric element or the like as the actuator is referred to as a piezoelectric type, and a type using an electrostatic actuator is referred to as an electrostatic type. In addition, hereinafter, the discharge port, the pressure chamber, and the actuator are also collectively referred to as a nozzle.

In such ink jet apparatuses, an abnormality may occur in the nozzle such that bubbles are generated within the discharge port or the pressure chamber, or a contaminant adheres to the inside of the discharge port or the pressure chamber. In this case, a printing failure may occur such that the nozzle is clogged or the liquid is not discharged, or the liquid is discharged in directions different from usual. In order to reduce such a printing failure, there are known ink jet apparatuses that have the function of recovering the nozzle to a normal state when the state of the nozzle is determined and an abnormality has occurred in the nozzle.

For example, in an ink jet apparatus using actuators, it is known that a vibration pattern of damped vibration called residual vibration generated in an actuator immediately after the actuator is driven to displace a wall of a pressure chamber changes according to the state of a nozzle. Since a voltage applied to the actuator changes if the actuator vibrates, it is possible to detect this voltage to thereby determine the state of the nozzle from the detected voltage.

However, since a determination circuit that detects the voltage applied to the actuator to determine the state of the nozzle is relatively large, if the determination circuit is provided at every nozzle in order to determine the state of each of a plurality of the nozzles, the size of the ink jet apparatus becomes too large.

In contrast, in order to reduce the size of the ink jet apparatus, ink jet apparatuses that determine the state of a plurality of nozzles, using one determination circuit, are disclosed in International Publication No. WO2004/076180 and Japanese Patent Application Laid-Open No. 2005-305992.

The ink jet apparatus described in International Publication No. WO2004/076180 has a switch to connect an actuator to a drive circuit outputting a driving current for driving the actuator or to a determination circuit that determines the state of a nozzle. In this ink jet apparatus, after a driving current is supplied from the drive circuit to the actuator, the switch is switched to connect the actuator to the determination circuit to detect a voltage applied to the actuator. In addition, the ink jet apparatus having one switch common to all nozzles is disclosed in FIG. 27 of International Publication No. WO2004/076180, and the ink jet apparatus having a plurality of switches corresponding to the nozzles, respectively, is disclosed in FIG. 30.

Additionally, in the ink jet apparatus described in Japanese Patent Application Laid-Open No. 2005-305992, one end of each of a plurality of actuators is connected to a drive circuit that outputs a driving signal, and the other end of the actuator is connected to a residual vibration detection circuit that detects residual vibration from a voltage applied to the actuator. In addition, the residual vibration detection circuit determines the state of a nozzle from a vibration pattern of the detected residual vibration. Additionally, in this ink jet apparatus, one switch is provided between the plurality of actuators and the residual vibration detection circuit, and it is possible to connect the plurality of actuators to one residual vibration detection circuit.

However, the ink jet apparatus disclosed in FIG. 27 of International Publication No. WO2004/076180 has a problem in that the operating speed of the ink jet apparatus decreases when the apparatus has a large number of nozzles.

In this ink jet apparatus, a driving current for driving a plurality of nozzles flows to a switch that connects actuators to the drive circuit. Since this driving current becomes larger as the number of nozzles to be driven increases, when a large number of nozzles are driven, an analog switch capable of handling a high current is required.

However, this ink jet apparatus should connect the determination circuit and an actuator to detect the voltage of the actuator immediately after a driving current is passed, and then connect the drive circuit and the actuator again until a driving current is output. For this reason, the analog switch needs to start a switching operation sufficiently earlier than the head of the driving signal of the drive circuit, and complete the switching operation before the head of the driving signal to pass the current of the driving signal therethrough. Additionally, the analog switch needs to start a switching operation at a rear end of the driving signal and determine the state of a nozzle through the determination circuit after the completion of the switching operation. When the state of the nozzle is determined by the determination circuit after the completion of the switching operation at the rear end of the driving signal, there is a problem in that the residual vibration is already attenuated and precise determination is difficult.

Allowance of the precise determination is limited to an ink jet nozzle designed so that the residual vibration of an actuator lasts a relatively long time. However, it is difficult for the ink jet nozzle in which the residual vibration of the actuator lasts a long time to be driven at a high frequency. Moreover, since the analog switch should start a switching operation sufficiently earlier than the head of the driving signal of the drive circuit, the driving signal is unable to be sent in a short cycle. Therefore, the operating speed of the ink jet apparatus decreases.

In contrast, it is considered that an analog switch with a fast operating speed is used by dividing actuators into a plurality of groups and driving the actuators in a time-sharing manner for every group to make the driving current small.

However, in the ink jet apparatus illustrated in FIG. 27 of International Publication No. WO2004/076180, a portion of a wiring line connecting an actuator to the drive circuit and a portion of a wiring line connecting the actuator to the determination circuit are shared. For this reason, it is necessary to provide most of the drive circuit driving the actuators for every group, and the scale of the circuit increases.

Additionally, in the ink jet apparatus disclosed in FIG. 30 of International Publication No. WO2004/076180, the plurality of switches are provided corresponding to the actuators, respectively. Therefore, it is possible to drive the actuators at a high speed. However, since a large-scale circuit that generates signals for switching the switches apart from a circuit that generates signals for driving the actuators is required, the circuit scale increases.

Additionally, in the ink jet apparatus disclosed in Japanese Patent Application Laid-Open No. 2005-305992, the residual vibration detection circuit and the actuators are unable to be individually connected to each other or disconnected from each other. For this reason, in this ink jet apparatus, the actuators should be driven one by one only in order to detect a voltage according to residual vibration apart from printing processing, and the operating speed of the ink jet apparatus decreases.

In addition, in the ink jet apparatus in Japanese Patent Application Laid-Open No. 2005-305992, the potential of one end on a grounding side of an actuator connected to the residual vibration detection circuit is detected by being isolated from the grounding side during residual vibration detection. For this reason, this method also has a problem in that the application range thereof is limited to an ink jet apparatus of the structure capable of electrically isolating one end on the grounding side of the actuator from the other.

SUMMARY OF THE INVENTION

According to one aspect of an embodiment, an ink jet apparatus includes a plurality of actuators that correspond to a plurality of discharge ports, respectively, and discharge a liquid from the discharge port according to a driving signal input to an input terminal; a driving signal source that outputs the driving signal; a driving selector that outputs a drive switch control signal for the actuator to be driven among the plurality of actuators; a plurality of drive switches that correspond to the actuators, respectively, connect or disconnect the input terminal of the actuator and the driving signal source according to the drive switch control signal for the actuator, and allow the driving signal to pass therethrough and input the driving signal to the input terminal when the input terminal and the driving signal source are connected; a detection circuit that detects a voltage of the input terminal when being connected to the input terminal; and a plurality of detection switches that correspond to the actuators, respectively, and connect or disconnect the input terminal of the actuator and the detection circuit, on the basis of the drive switch control signal for the actuator or the driving signal passed through the drive switch corresponding to the actuator.

According to another aspect of an embodiment, a method for controlling an ink jet apparatus includes a plurality of actuators that correspond to a plurality of discharge ports, respectively, and discharge a liquid from a discharge port according to a driving signal input to an input terminal; a driving signal source that outputs the driving signal; a driving selector that outputs a drive switch control signal for the actuator to be driven among the plurality of actuators; a detection circuit that detects a voltage of the input terminal when being connected to the input terminal; a plurality of drive switches that correspond to the actuators, respectively, connect or disconnect the input terminal of the actuator and the driving signal source, and allow the driving signal to pass therethrough and input the driving signal to the input terminal when the input terminal and the driving signal source are connected; and a plurality of detection switches that correspond to the actuators, respectively, and connect or disconnect the input terminal of the actuator and the detection circuit, wherein each of the drive switches is made to connect or disconnect the input terminal of the actuator and the driving signal source, according to the drive switch control signal for the actuator, and each of the detection switches is made to connect or disconnect the input terminal of the actuator and the detection circuit, on a basis of the drive switch control signal for the actuator or the driving signal passed through the drive switch corresponding to the actuator.

Further features of the present invention will become apparent from the following description of exemplary embodiments with reference to the attached drawings.

DESCRIPTION OF THE EMBODIMENTS

Figure 1:
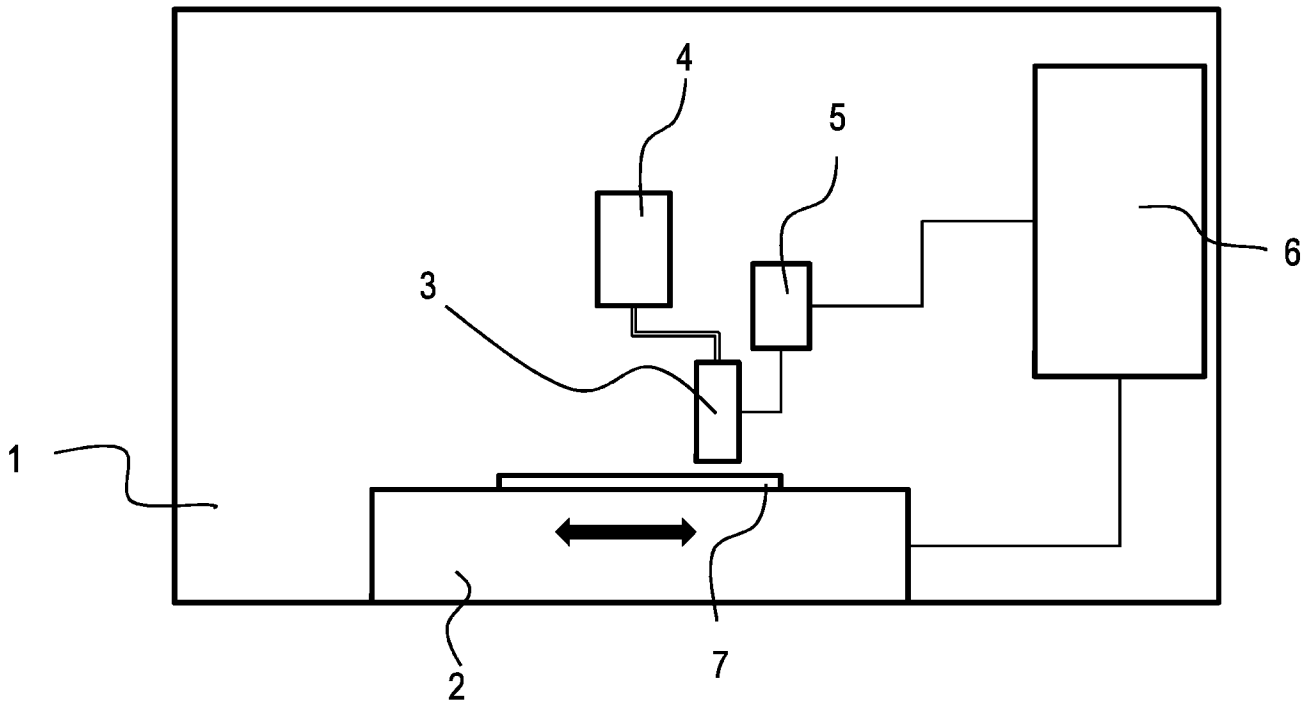
FIG. 1 is a view for describing the configuration of an ink jet apparatus 1 related to a first embodiment of the invention.

Preferred embodiments of the invention will now be described in detail with reference to the accompanying drawings. In addition, in the present specification and drawings, duplication of descriptions may be omitted by giving the same reference numerals to constituent elements having the same functions.

First Embodiment

FIG. 1 is a view for describing the configuration of an ink jet apparatus 1 related to a first embodiment of the invention.

The ink jet apparatus 1, which is a liquid discharge apparatus that discharges a liquid, discharges ink as the liquid in the present embodiment.

The ink jet apparatus 1 has a stage 2, an ink jet head 3, a discharge liquid supply device 4, a head electric controller 5, and an apparatus controller 6.

The stage 2 is a platform that is movable within a housing of the ink jet apparatus 1 and on which an object 7 to be printed on is placed. In addition, the object 7 to be printed on is paper, a substrate, or the like, and the object 7 to be printed on is paper in the present embodiment.

The ink jet head 3 has discharge ports that discharge ink, and the discharge ports face the stage 2. Accordingly, the ink discharged from the discharge ports lands on the object 7 to be printed on, which is placed on the stage 2. As the ink jet head 3 discharges ink in synchronization with the movement of the stage 2, a predetermined pattern is formed on the object 7 to be printed on.

The discharge liquid supply device 4 is connected to the ink jet head 3, and supplies ink to the ink jet head 3.

The head electric controller 5 is connected to the ink jet head 3, and controls the ink jet head 3.

The apparatus controller 6 controls the ink jet apparatus 1. Specifically, the apparatus controller 6 causes the stage 2 to move, or causes ink to be discharged to the ink jet head 3 in synchronization with the movement of the stage 2, on the basis of printing data indicating a predetermined pattern to be formed on the object 7 to be printed on, using the head electric controller 5. Accordingly, the apparatus controller 6 causes an image according to the printing data to be formed on the object 7 to be printed on. Moreover, if the apparatus controller 6 is notified that the state of a nozzle is abnormal, the apparatus controller causes the operation for recovering the state of the nozzle to be performed. The operation for recovering the state of the nozzle is, for example, the operation of wiping a surface in which the discharge ports of the ink jet head 3 are formed, the operation of sucking the nozzle, or the like.

Figure 2:
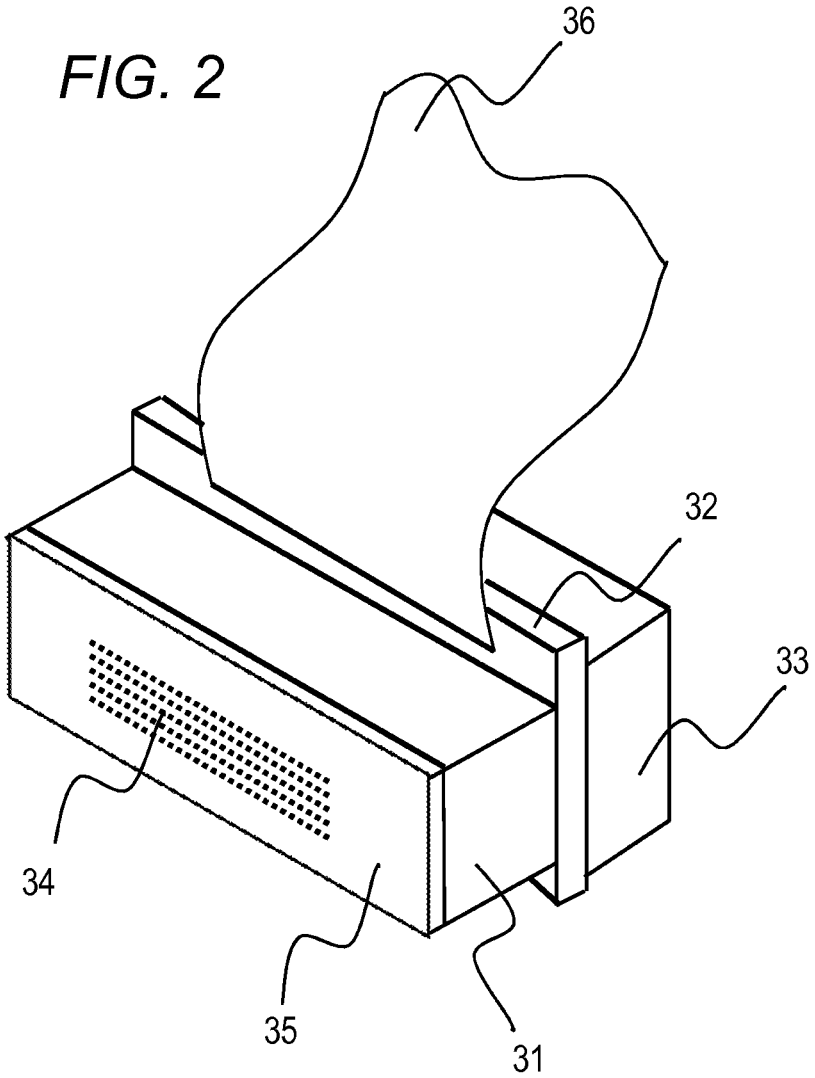
FIG. 2 is a view for describing main portions of an ink jet head 3 of FIG. 1.

FIG. 2 is a view for describing main portions of the ink jet head 3.

The ink jet head 3 has a nozzle block 31, a drive circuit plate 32, and a liquid chamber member 33.

The nozzle block 31 has an orifice plate 35 in which a plurality of discharge ports 34 that discharges ink are provided side by side. Additionally, the nozzle block 31 has a plurality of nozzles including the discharge ports 34, respectively.

Figure 3:
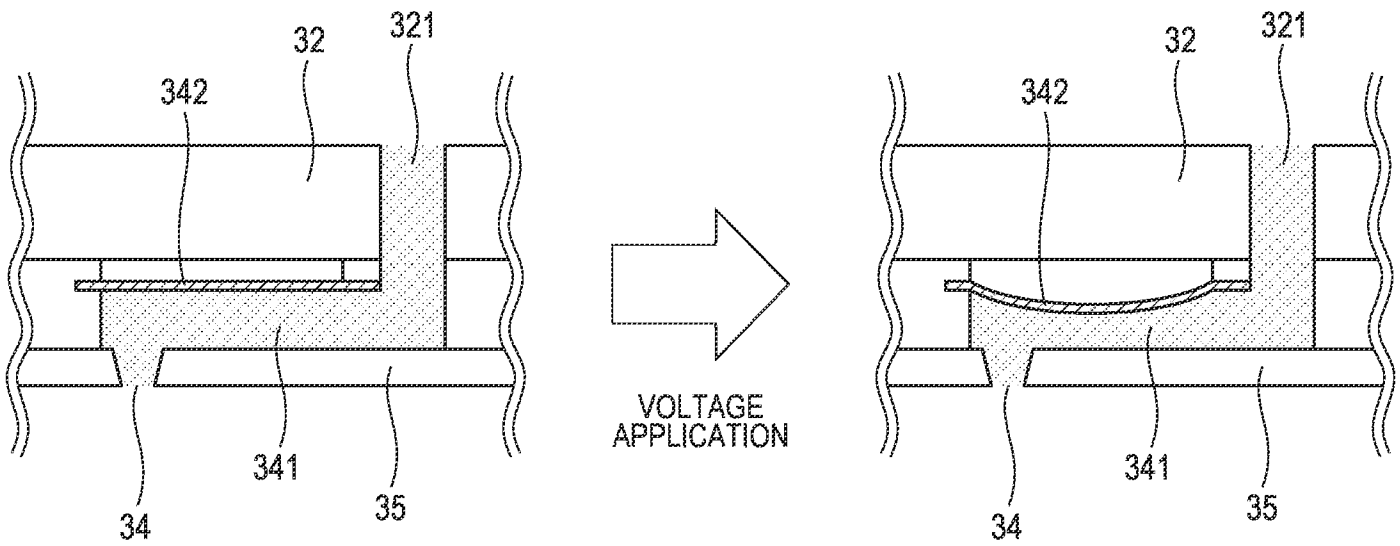
FIG. 3 is a view illustrating an example of the configuration of a nozzle included in a nozzle block 31 of FIG. 2.

FIG. 3 is a view for describing an example of the configuration of a nozzle included in the nozzle block 31. Each nozzle included in the nozzle block 31 includes a discharge port 34, a pressure chamber 341 that communicates with the discharge port 34, and a piezoelectric element 342 that is an actuator that displaces a portion of a wall of the pressure chamber 341. The piezoelectric element 342 has an input terminal, and is deformed according to a driving signal input to the input terminal. In the present embodiment, the piezoelectric element 342 itself constitutes a portion of the wall of the pressure chamber 341. Therefore, if a driving signal is input to the input terminal of the piezoelectric element 342, the piezoelectric element 342 is deformed and the volume of the pressure chamber 341 decreases. For this reason, ink is discharged from the discharge port 34.

Refer back to the description of FIG. 2.

The drive circuit plate 32 is made of silicon (Si), and a portion of a drive circuit that drives the piezoelectric element 342 is built into the drive circuit plate 32. The drive circuit is connected to the input terminal of each piezoelectric element 342, and a driving signal is input to the input terminal. Additionally, in the drive circuit plate 32, a through-hole 321 is provided corresponding to each nozzle. Additionally, the drive circuit plate 32 is connected to the head electric controller 5 via a cable 36, and generates a driving signal for driving the piezoelectric element 342 in cooperation with the head electric controller 5.

The liquid chamber member 33 is connected to the discharge liquid supply device 4 by a pipe (not illustrated), and supplies the ink supplied from the discharge liquid supply device 4 to the pressure chamber 341 in the nozzle block 31 through the through-hole provided in the drive circuit plate 32.

Figure 4:
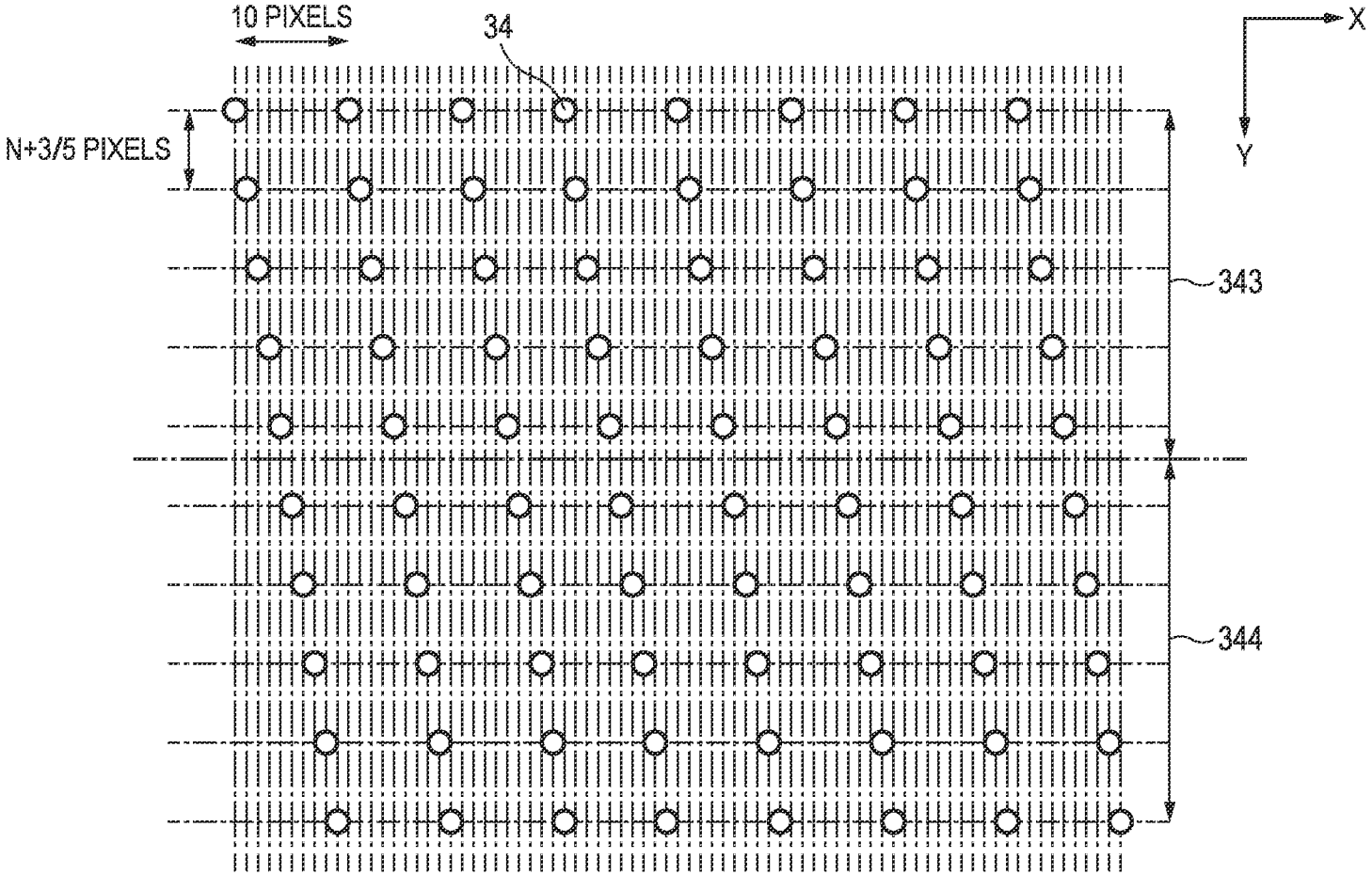
FIG. 4 is a view illustrating an example of the arrangement of discharge ports 34 provided in the ink jet head 3 of FIG. 2.

FIG. 4 is a view illustrating an example of the arrangement of the discharge ports 34 of FIG. 2.

In the example of FIG. 4, the discharge ports 34 are lined up at intervals equivalent to 10 pixels in an X direction. Ten layers of discharge port columns are arranged in the discharge ports 34 in a Y direction, and the layers are lined so as to shift by one pixel in the X direction, respectively. Accordingly, it is possible for ink to land on the object 7 to be printed on at one-pixel pitches by sequentially discharging the ink while moving the object 7 to be printed on in the Y direction. The distance between the layers is N+3/5 pixels (N is an integer) in the Y direction.

In addition, in the present embodiment, the pitches of pixels to be recorded are 600 dpi, and the pitches of the pixels are 42.3 μm.

The ten layers of discharge port columns are divided into two groups 343 and 344 each having five layers, and each group has a different electric system that drives the discharge ports 34 corresponding to the piezoelectric elements 342, respectively.

Figure 5:
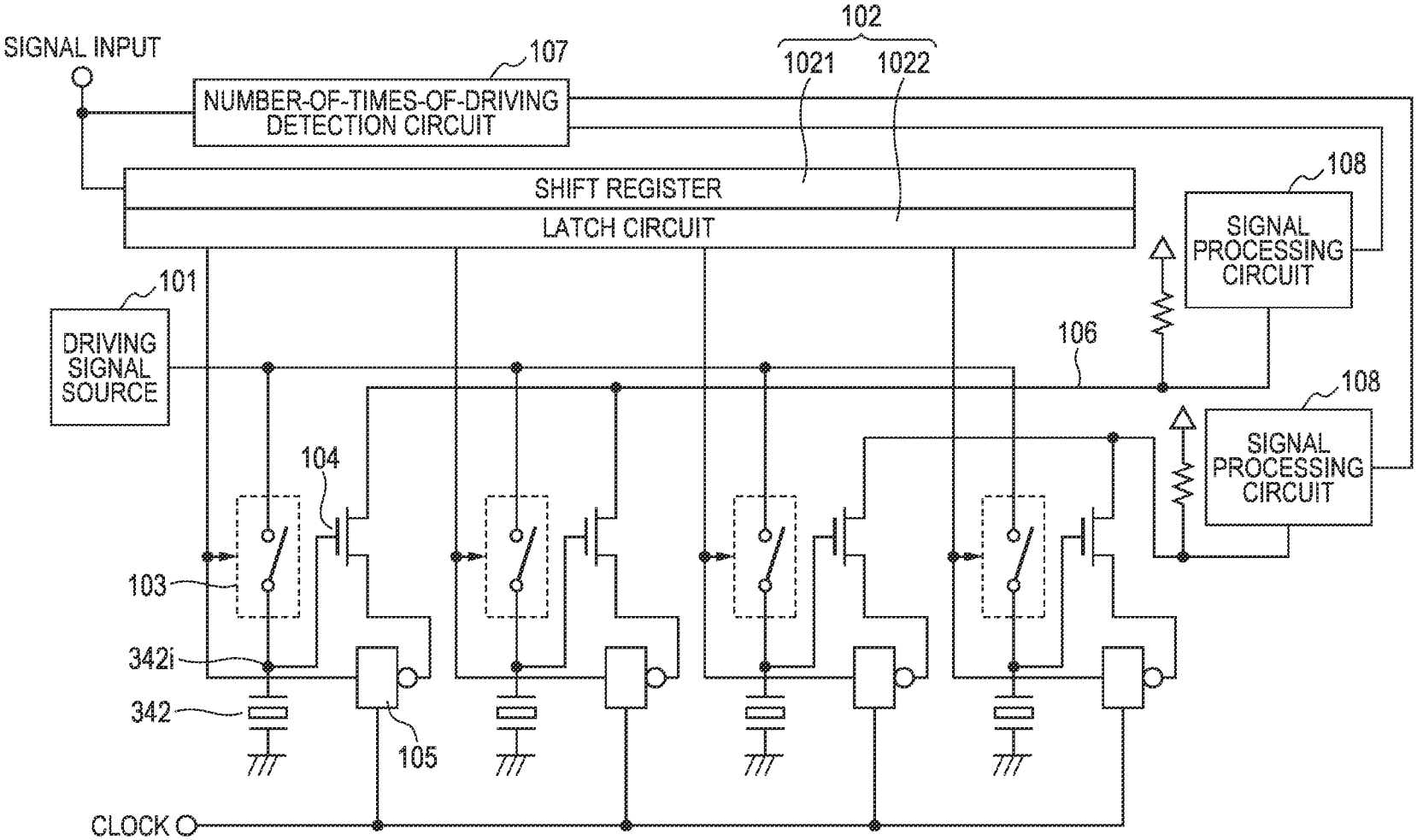
FIG. 5 is a view for describing the configuration of main portions of a drive circuit of the ink jet apparatus 1 related to the first embodiment.

FIG. 5 is a view for describing main portions of the drive circuit related to the present embodiment.

The drive circuit illustrated in FIG. 5 has a driving signal source 101, a driving selector 102, drive switches 103, transistors 104, one-bit latch circuits 105, wiring lines 106, a number-of-times-of-driving detection circuit 107, and signal processing circuits 108. Additionally, the driving selector 102 includes a shift register 1021 and a latch circuit 1022.

The drive switches 103, the transistors 104, and the one-bit latch circuits 105 are provided corresponding to the plurality of piezoelectric elements 342, respectively. Additionally, the piezoelectric elements 342 are divided into a plurality of groups, and the signal processing circuits 108 are provided corresponding to the groups, respectively.

In addition, for simplicity, only the portion that drives some of the nozzles illustrated in FIG. 4 is illustrated in FIG. 5. Additionally only the portion that drives four nozzles is illustrated in FIG. 5, the four nozzles are divided into two groups, and each group is provided with one wiring line 106 and one signal processing circuit 108. The respective portions of the drive circuit illustrated in FIG. 5 are built in the drive circuit plate 32 or the head electric controller 5.

The piezoelectric elements 342 are provided corresponding to the plurality of discharge ports 34, respectively. Each piezoelectric element 342 has one end serving as an input terminal 342*i*, is driven according to a driving signal input to the input terminal 342*i*, and discharges a liquid from a corresponding discharge port 34. The other end of the piezoelectric element 342 is grounded.

The driving signal source 101 generates a driving signal for driving the piezoelectric element 342. The driving signal source 101 generates and outputs driving signals for driving all of the five layers of the nozzles. For this reason, the frequency of a driving signal output from the driving signal source 101 becomes five times greater than a driving frequency that drives each layer of the nozzles. The driving signal source 101 is connected to each of the plurality of drive switches 103.

The driving selector 102 outputs a drive switch control signal for a piezoelectric element 342 to be driven among the plurality of piezoelectric elements 342. Specifically, the driving selector 102 includes a shift register 1021 and a latch circuit 1022, the shift register 1021 receives information for specifying a piezoelectric element 342 to be driven according to printing data from the apparatus controller 6, and stores the received information. The latch circuit 1022 latches the information stored in the shift register 1021, and outputs the latched information to a drive switch 103 corresponding to the piezoelectric element 342 to be driven as a drive switch control signal. The drive switch control signal indicates a period, during which the piezoelectric element 342 to be driven is driven, at a high level, and indicates a period, during which the piezoelectric element 342 is not driven, at a low level.

The drive switches 103 are provided corresponding to the piezoelectric elements 342, respectively. Each drive switch 103 connects or disconnects the input terminal of a corresponding piezoelectric element 342 and a corresponding drive switch 103 according to the input drive switch control signal. When the drive switch 103 has connected the input terminal and the drive switch 103, the drive switch 103 allows the driving signal output from the driving signal source 101 to pass therethrough, and inputs the driving signal to the input terminal.

The transistors 104 are provided corresponding to the piezoelectric element 342, respectively, and each transistor 104 has a gate connected to a corresponding piezoelectric element 342, a drain connected to a signal processing circuit 108 via a wiring line 106, and a source connected to a one-bit latch circuit 105. The transistor 104 is a detection switch that, on the basis of a drive switch control signal for the corresponding piezoelectric element 342, connects or disconnects the input terminal 342*i* of the piezoelectric element 342 and the signal processing circuit 108. Additionally, the transistor 104 amplifies the voltage of the connected input terminal 342*i* to output the amplified voltage to the wiring line 106. Accordingly, the source potential of the transistor 104 becomes a low level immediately after the drive switch control signal input to the drive switch 103 connected to the corresponding piezoelectric element 342 becomes a high level. Since a potential difference is caused between the gate and the source of the transistor 104 at this time, the transistor 104 amplifies the voltage of the input terminal 342*i* and outputs the amplified voltage to the signal processing circuit 108. Additionally, the transistor 104 is brought into a state where the input terminal 342*i* and the signal processing circuit 108 are disconnected, other than immediately after the drive switch control signal becomes a high level.

The one-bit latch circuit 105 is a delay circuit that is provided corresponding to each piezoelectric element 342 and that delays the drive switch control signal input to the drive switch 103 connected to the corresponding piezoelectric element 342. The one-bit latch circuit 105 receives the drive switch control signal input to the drive switch 103 connected to the corresponding piezoelectric element 342. The one-bit latch circuit 105 latches the drive switch control signal at a falling edge of the received drive switch control signal, reverses the latched drive switch control signal, and outputs the reversed signal.

The wiring line 106 connects the plurality of transistors 104 with the signal processing circuit 108.

The number-of-times-of-driving detection circuit 107 receives the information for specifying the piezoelectric element 342 to be driven according to the printing data from the apparatus controller 6, and detects the number of piezoelectric elements 342 to be simultaneously driven for every group into which the piezoelectric elements 342 are divided, on the basis of the received information. When the detected number is a predetermined number, the number-of-times-of-driving detection circuit 107 transmits a signal indicating that the number-of-times-of-driving is detected to the signal processing circuit 108 corresponding to the relevant group. In addition, the predetermined number may be 1.

The signal processing circuit 108 is a detection circuit that is connected to the input terminal 342*i* of a piezoelectric element 342 according to the state of a transistor 104, and detects the voltage of the relevant input terminal 342*i* when being connected to the input terminal 342*i*. Additionally, the signal processing circuit 108 has the function of determining the state of a nozzle included in each piezoelectric element 342, on the basis of the waveform pattern of the detected voltage. In addition, the signal processing circuit 108 may determine the state of the nozzle at a timing that is notified from the number-of-times-of-driving detection circuit 107, and may not determine the state of the nozzle even if a voltage is detected during which the notification is not received. The signal processing circuit 108 notifies the state of the determined nozzle to the apparatus controller 6.

Figure 6:
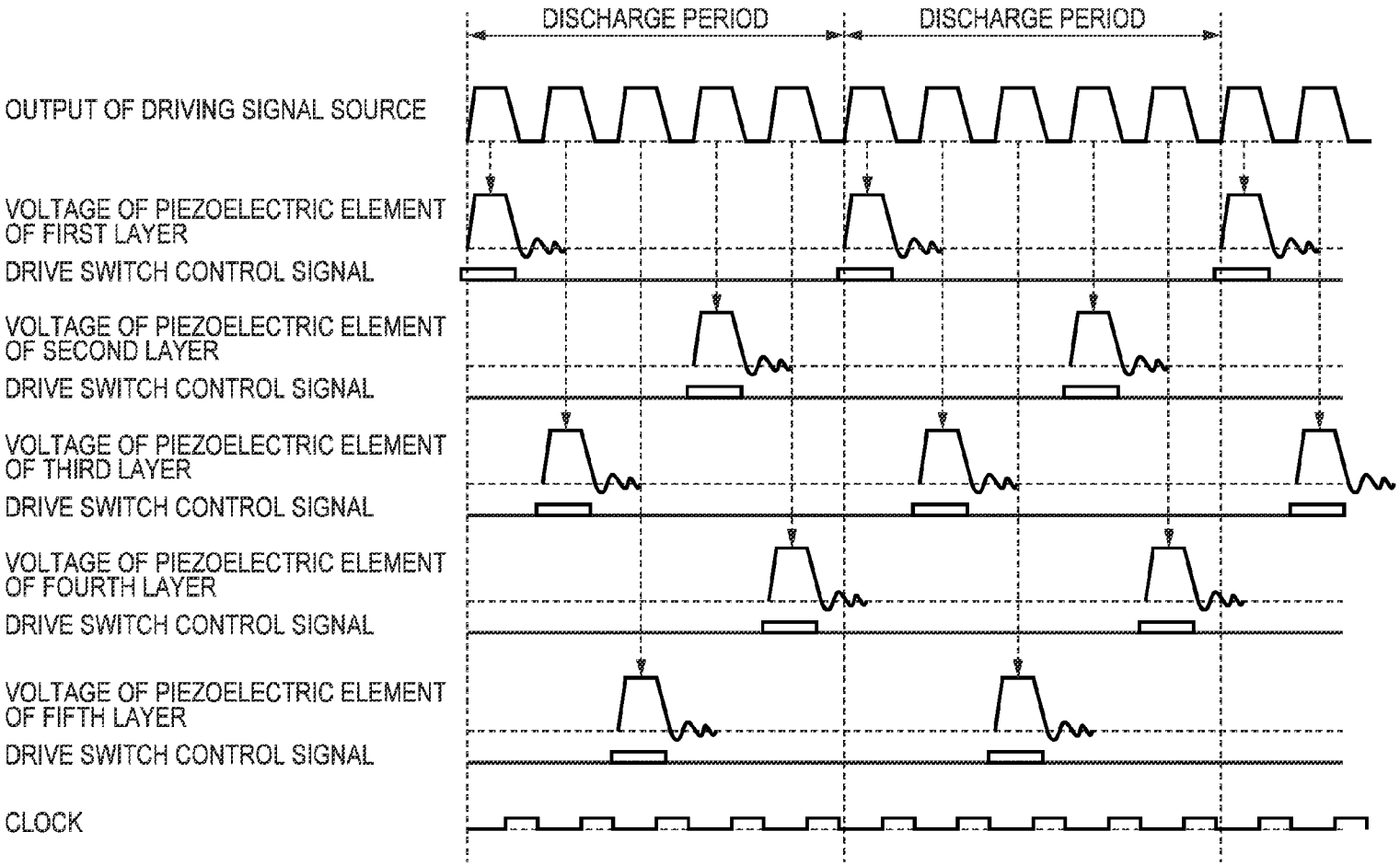
FIG. 6 is a view for describing the operation timing of the drive circuit in the ink jet apparatus 1 related to the first embodiment.

FIG. 6 is a view for describing the operation timing of the drive circuit in the ink jet apparatus 1 related to the present embodiment.

As illustrated in FIG. 6, the driving signal source 101 periodically outputs a driving signal having a predetermined waveform. This driving signal is supplied to each drive switch 103.

Additionally, during a period in which a drive switch control signal is at a high level, a state where the drive switch 103 has connected the driving signal source 101 and the input terminal 342*i* of a piezoelectric element 342 is brought about, and the driving signal is input to the input terminal 342*i*. For this reason, during the period in which the drive switch control signal input to the drive switch 103 is at the high level, a voltage applied to the piezoelectric element 342 connected to the drive switch 103 becomes a value according to the waveform of the driving signal. In the example of FIG. 6, the piezoelectric elements 342 are driven in order of a first layer, a third layer, a fifth layer, a second layer, and a fourth layer.

Additionally, during a period in which a drive switch control signal input to the drive switch 103 is at a low level, a voltage is not applied to the piezoelectric element 342 connected to the drive switch 103. However, the piezoelectric element 342 continues damped vibration called residual vibration immediately after the piezoelectric element 342 is deformed according to the driving signal. For this reason, after the drive switch 103 is brought into an opened state and is electrically isolated from the driving signal source 101, a voltage according to the residual vibration is generated in the piezoelectric element 342. Since the pattern of the residual vibration changes depending on the state of a nozzle, it is possible to determine the state of the nozzle from the change pattern of this voltage.

Two signal processing circuits 108 are illustrated in FIG. 4. The plurality of signal processing circuits 108 are provided in order to divide the nozzles into a plurality of groups and to discriminate the states of the nozzles for every group. By providing the plurality of groups to make the number of nozzles belonging to one group small, when the ink jet apparatus 1 is printing a usual image or the like, it is possible to enhance the probability that the number-of-times-of-driving detection circuit 107 detects the predetermined number. Specifically, the aforementioned predetermined number may be a relatively small number according to the number of the nozzles belonging to one group. As a result, it is possible to increase the frequency with which the states of the nozzles are determined, it is possible to reduce the probability that the malfunction of a nozzle being neglected may be decreased, and it is possible to keep the quality of an object to be printed on high.

If nozzles in a layer to be continuously driven are divided so as to belong to different groups in dividing the nozzles into the plurality of groups, it is possible to determine the states of the nozzles without decreasing the printing speed of the ink jet apparatus 1. If description is made with reference to FIG. 6, piezoelectric elements 342 of a first layer is driven, and piezoelectric elements 342 of a third layer is driven continuously with piezoelectric elements 342 of the first layer. Thus, if the nozzles of the first layer and the nozzles of the third layer are divided into separate groups, wiring lines 106 are separately provided for the different groups. Thus, signals accompanying the driving of the nozzles of the third layer are rarely mixed as noise when the residual vibration of the nozzles of the first layer is detected. Moreover, even if the influence of the residual vibration of the nozzles of the first layer remains in the stage of detecting the residual vibration of the nozzles of the third layer, the residual vibration of the nozzles of the third layer is not influenced by the residual vibration of the nozzles of the first layer because the signals are processed by the separate signal processing circuits 108.

In addition, in the above-described example, each signal processing circuit 108 determines the states of nozzles to be simultaneously driven within the same group when the number of the nozzles is a predetermined number. However, the invention is not limited to this example. For example, the states of the nozzles may be determined by driving the nozzles one by one prior to printing processing.

Additionally, in the above-described example, the transistor 104 connects and disconnects the input terminal 342*i* of the piezoelectric element 342 and the signal processing circuit 108, according to the signal of the one-bit latch circuit 105 that has delayed the drive switch control signal. However, the invention is not limited to this example. For example, the one-bit latch circuit 105 may latch a driving signal passed through the drive switch 103, and the transistor 104 may connect or disconnect the input terminal 342*i* of the piezoelectric element 342 and the signal processing circuit, according to a signal that has latched this driving signal.

As described above, according to the present embodiment, the ink jet apparatus 1 has the drive switch 103 that connects or disconnects the input terminal of the piezoelectric element 342, which is an actuator, and the driving signal source 101. Additionally, the ink jet apparatus 1 has the transistor 104 that is a detection switch that connects or disconnects the input terminal 342*i* of the piezoelectric element 342 and the signal processing circuit 108 that is a detection circuit.

In this way, since a path along which the driving signal is input to each piezoelectric element 342 and a path along which the voltage of the piezoelectric element 342 is detected are different, it is possible to detect the voltage applied to the piezoelectric element 342 in parallel with printing processing. Accordingly, it is possible to suppress a decrease in the operating speed of the ink jet apparatus 1. Additionally, since the drive switch 103 and the transistor 104 operate independently, it is possible to shorten the time ranging from when a path is disconnected out of the path along which the driving signal is input to the piezoelectric element 342 and the path along which the voltage of the piezoelectric element 342 is detected to when the other path is connected. For this reason, it is possible to further suppress the decrease in the operating speed of the ink jet apparatus 1. Additionally, the transistor 104 connects or disconnects the input terminal 342*i* and the signal processing circuit 108, on the basis of the drive switch control signal input to the drive switch 103 connected to the corresponding piezoelectric element 342 or the driving signal passed through the drive switch 103. Accordingly, it is not necessary to provide an independent configuration in order to generate a control signal that instructs the operation of the transistor 104, and it is possible to suppress an increase in circuit scale. Additionally, if the voltage of the input terminal 342*i* is detected, it is possible to determine the state of a nozzle on the basis of the detected voltage. Accordingly, it is possible to suppress a decrease in operating speed and an increase in circuit scale, while enabling the states of a number of nozzles to be determined.

In addition, since it is not necessary to electrically isolate one end of the piezoelectric element 342 on a grounding side from the other, there is also an effect that the application range is wide.

Additionally, according to the present embodiment, there is provided the delay circuit that corresponds to each piezoelectric element 342 and delays and outputs the drive switch control signal for the corresponding piezoelectric element 342 or the driving signal passed through the drive switch. The input terminal 342*i* and the signal processing circuit 108 are connected or disconnected according to the signal output from the delay circuit. Accordingly, it is possible to detect the voltage of the input terminal 342*i* according to the timing at which the piezoelectric element 342 is driven. Accordingly, since the signal processing circuit 108 is able to more reliably detect a voltage generated according to residual vibration, it is possible to improve the precision with which the state of a nozzle is determined.

Additionally, according to the present embodiment, the latch circuit that latches the drive switch control signal for the corresponding piezoelectric element 342 or the driving signal passed through the drive switch 103 corresponding to the piezoelectric element 342 is used as the delay circuit. Accordingly, since it is possible to connect the piezoelectric element 342 to the signal processing circuit 108 immediately after the piezoelectric element 342 is driven, and it is possible to more reliably detect the voltage generated according to residual vibration, it is possible to improve the precision with which the state of a nozzle is determined.

Additionally, according to the present embodiment, the transistor that amplifies the voltage of the input terminal 342*i* is used as the detection switch. Accordingly, since it is possible to amplify and detect the voltage of the input terminal 342*i*, it is possible to decrease the influence of noise included in the detected voltage, and it is possible to improve the precision with which the state of a nozzle is determined.

Additionally, according to the present embodiment, the piezoelectric elements 342 are divided into the plurality of groups, and the voltages of the input terminals 342*i* are detected for every group. Accordingly, since it is possible to perform the processing of determining the states of the nozzles in parallel for every group, it is possible to further suppress the decrease in the operating speed of the ink jet apparatus 1.

Additionally, according to the present embodiment, when the number of piezoelectric elements 342 to be simultaneously driven is a predetermined number, the state of a nozzle including a corresponding piezoelectric element 342 is determined on the basis of the detected voltage. The voltage detected by the signal processing circuit 108 is a voltage obtained as the voltages applied to the piezoelectric elements 342 that are simultaneously driven overlap each other, and it is necessary to detect the voltages when a fixed number of nozzles are driven in order to precisely determine the state of a nozzle. For this reason, as it is detected that the number of the nozzles that are simultaneously driven is a predetermined number and the state of a nozzle is determined at this time, it is possible to determine the state of the nozzle in parallel with printing processing, without driving the piezoelectric elements 342 one by one only in order to determine the state of the nozzle. Accordingly, it is possible to further suppress a decrease in the operating speed of the ink jet apparatus 1.

Additionally, in the present embodiment, the state of a nozzle is determined when it is detected that the number of nozzles to be simultaneously driven is 1. Accordingly, it is possible to detect a voltage for every nozzle. As a result, since a voltage waveform when an abnormality has occurred in a nozzle is not equalized by a voltage waveform resulting from normal residual vibration, it is possible to improve the precision with which the state of noise is determined.

Second Embodiment

Figure 7:
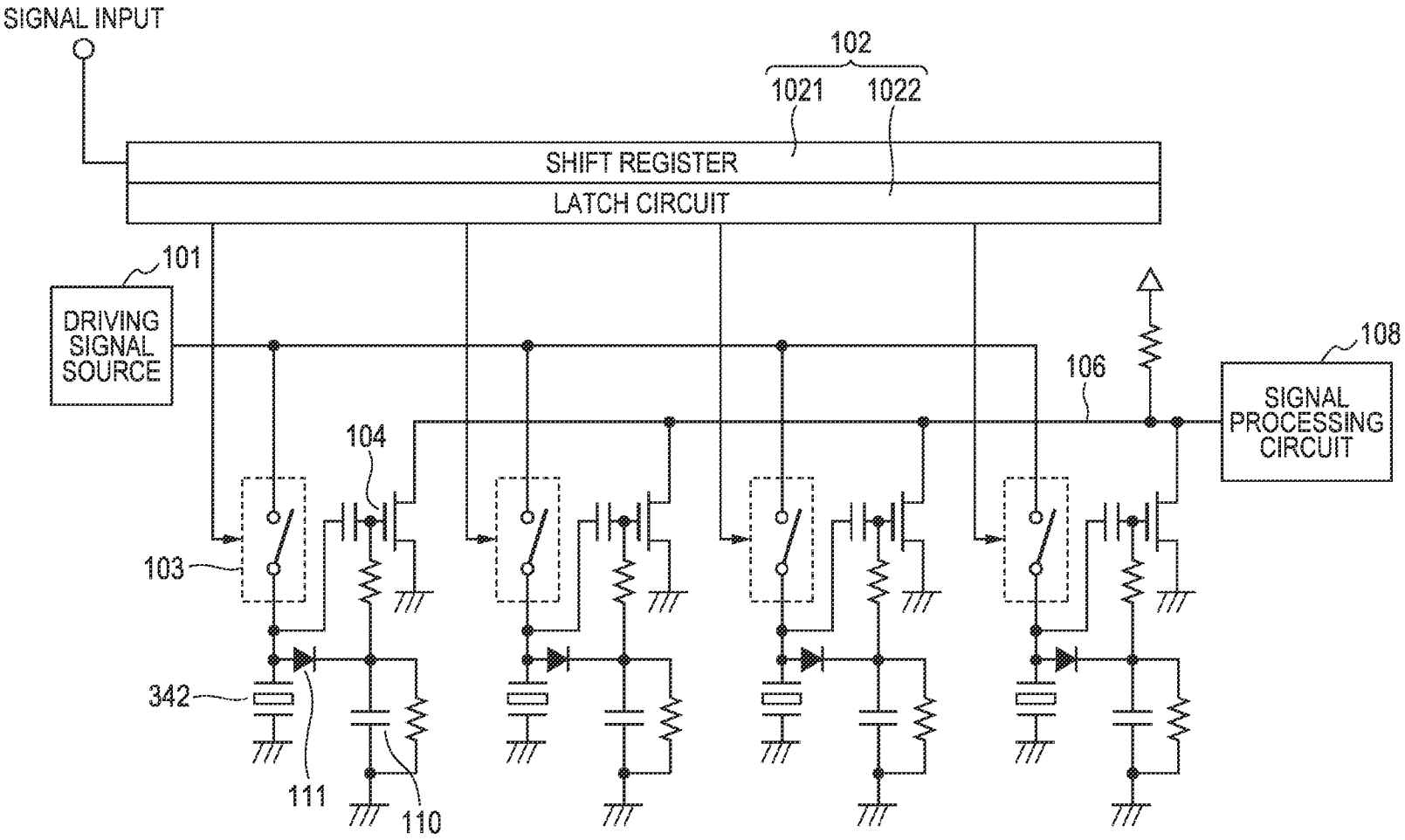
FIG. 7 is a view for describing the configuration of main portions of a drive circuit related to a second embodiment of the invention.

FIG. 7 is a view for describing main portions of a drive circuit of an ink jet apparatus related to a second embodiment of the invention. In addition, since the overall configuration of the ink jet apparatus related to the present embodiment is the same as that of the first embodiment described with reference to FIG. 1, the description thereof will be omitted herein.

The drive circuit illustrated in FIG. 7 has the driving signal source 101, the driving selector 102, the drive switches 103, the transistors 104, the wiring line 106, a signal processing circuit 108, capacitors 110, and diodes 111. Additionally, the driving selector 102 includes the shift register 1021 and the latch circuit 1022.

The drive switches 103, the transistors 104, the capacitors 110, and the diodes 111 are provided corresponding to the plurality of piezoelectric elements 342, respectively.

In addition, although the portion that drives the nozzles classified into one group is illustrated in FIG. 6 for simplicity, the plurality of signal processing circuits 108 may be provided similar to the first embodiment.

In the first embodiment, the state of the transistor 104 is switched using the one-bit latch circuit 105 that latches the drive switch control signal for the corresponding piezoelectric element 342 or the driving signal passed through the drive switch 103 corresponding to the piezoelectric element 342. In contrast, in the present embodiment, the state of a transistor 104 is switched using a capacitor 110 that stores a driving signal passed through a drive switch 103 corresponding to a piezoelectric element 342.

The capacitor 110 has one end grounded and the other end connected to the piezoelectric element 342 via a diode 111. Additionally, one end connected to the diode 111 is connected to the gate of the transistor 104. Additionally, the source of the transistor 104 is grounded.

Accordingly, if a driving signal is supplied to the input terminal 342*i* of the piezoelectric element 342, the capacitor 110 is charged and a potential difference is caused between the gate and the source of the transistor 104. Accordingly, the transistor 104 amplifies the voltage of the connected input terminal 342*i* to output the amplified voltage to the signal processing circuit 108.

Additionally, in FIG. 6, the capacitor 110 receives the driving signal passed through the corresponding drive switch 103 and is charged. However, the invention is not limited to this example. For example, the wiring line that transmits the drive switch control signal and the capacitor 110 may be connected, and the capacitor 110 may receive the drive switch control signal for the corresponding piezoelectric element 342 and be charged. Even in this case, as the capacitor 110 is charged, it is possible to switch the state of the transistor 105.

As described above, in the present embodiment, the capacitor 110 that stores the drive switch control signal for the corresponding piezoelectric element 342 or the driving signal passed through the drive switch is used instead of the one-bit latch circuit 105 in the first embodiment. Accordingly, in the present embodiment, it is also possible to suppress a decrease in operating speed and an increase in circuit scale, while enabling the states of a number of nozzles to be determined.

Third Embodiment

Figure 8:
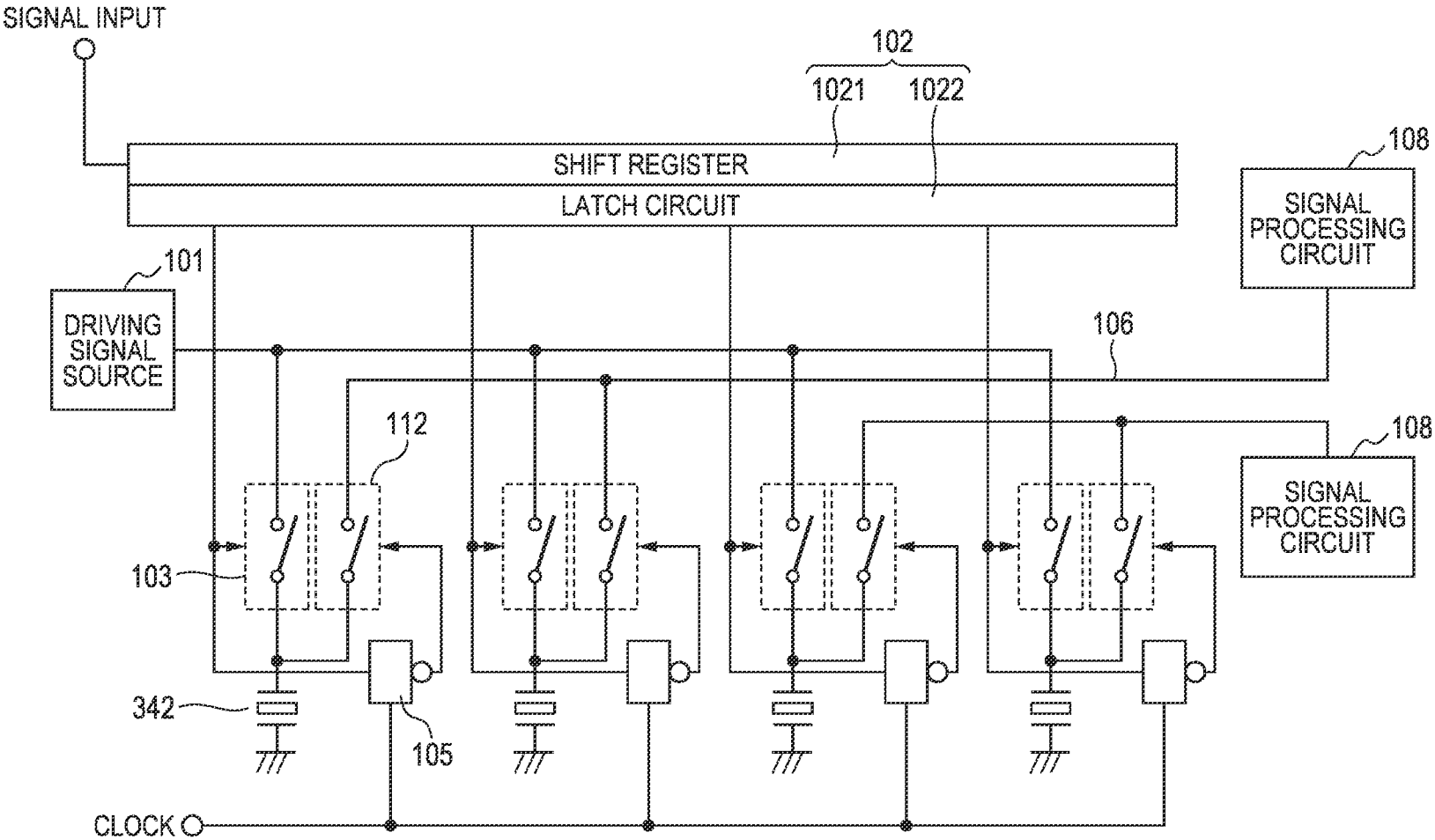
FIG. 8 is a view for describing the configuration of main portions of a drive circuit related to a third embodiment of the invention.

FIG. 8 is a view for describing main portions of a drive circuit of an ink jet apparatus related to a third embodiment of the invention. In addition, since the overall configuration of the ink jet apparatus related to the present embodiment is the same as the configuration of the ink jet apparatus 1 related to the first embodiment described with reference to FIG. 1, the description thereof will be omitted herein.

The drive circuit illustrated in FIG. 8 has the driving signal source 101, the driving selector 102, the drive switches 103, the one-bit latch circuits 105, the wiring lines 106, the signal processing circuits 108, and analog switches 112. Additionally, the driving selector 102 includes the shift register 1021 and the latch circuit 1022.

The drive switches 103, the one-bit latch circuits 105, and the analog switches 112 are provided corresponding to the plurality of piezoelectric elements 342, respectively.

In the first and second embodiments, the transistors 104 are used as the detection switches. In the present embodiment, however, the analog switches 112 are used as the detection switches.

Each analog switch 112 has one end connected to a piezoelectric element 342 and the other end connected to a signal processing circuit 108 via a wiring line 106 for every group into which a nozzle corresponding to the connected piezoelectric element 342 is classified. Additionally, the analog switch 112 is connected to the one-bit latch circuit 105, a drive switch control signal is input from the one-bit latch circuit 105, and the piezoelectric element 342 and the signal processing circuit 108 are connected or disconnected according to this drive switch control signal.

When the analog switch 112 is used as the detection switch, there is no signal amplification action, but it is possible to detect residual vibration. In this case, it is possible to make the input impedance of the signal processing circuit 108 low to thereby enhance resistance against noise. As a method of ensuring detection sensitivity while making the input impedance of the signal processing circuit 108 low, it is also effective to use an input stage of the signal processing circuit 108 as a current detection amplifier.

In addition, in the ink jet apparatus related to the present embodiment, the switch that connects or disconnects the driving signal source 101 and the piezoelectric element 342, and the switch that connects or disconnects the piezoelectric element 342 and the signal processing circuit 108 are different from each other. For this reason, it is possible to switch the analog switch 112 in the midst of switching the drive switch 103. Moreover, since a driving signal may not be passed through the analog switch 112, but only a residual vibration signal may be passed through the analog switch 112, it is possible to provide an analog switch for a small signal capable of being operated at a high speed. Accordingly, even if the analog switch 112 is used, the operating speed of the ink jet apparatus is not decreased.

As described above, in the present embodiment, the analog switches 112 are used as the detection switches instead of the transistors 105. In the present embodiment, it is also possible to suppress a decrease in operating speed and an increase in circuit scale, while enabling the states of a number of nozzles to be determined.

Although the present invention has been described above with reference to the embodiments, the present invention is not limited to the above embodiments. It is possible to make various changes capable of being understood by those skilled in the art on the configuration and details of the present invention within the scope of the present invention.

For example, in the above embodiments, the actuators are the piezoelectric elements 342. However, the invention is not limited to this example. For example, the actuators may be actuators other than the piezoelectric elements, such as electrostatic actuators.

Additionally, in the above embodiments, the ink jet apparatus 1 is an apparatus that discharges ink. However, the invention is not limited to this example. It is possible to apply the configuration of the invention to general apparatuses that discharge liquids other than ink.

Additionally, in the above embodiments, the ink jet apparatus 1 is an apparatus that discharges ink to form an image on paper as an object to be printed on. However, the invention is not limited to this example. For example, the object to be printed on may be a substrate. In this case, if conductive ink is used, it is possible to form a wiring pattern on a substrate with discharged ink. Accordingly, with respect to an ink jet apparatus that includes a number of nozzles and determines the state of each nozzle, it is possible to reduce a decrease in operating speed and an increase in circuit scale.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-182898, filed Sep. 4, 2013, which is hereby incorporated by reference herein in its entirety.

What is claimed is:

1. An ink jet apparatus comprising:

a plurality of actuators that correspond to a plurality of discharge ports, respectively, and discharge a liquid from the discharge ports according to driving signals input to input terminals;

a driving signal source that outputs the driving signals;

a driving selector that outputs a drive switch control signal for an actuator to be driven among the plurality of actuators;

a plurality of drive switches that correspond to the actuators, respectively, connect or disconnect the input terminal of each of the actuators and the driving signal source according to the drive switch control signal for the actuator, and allow the driving signal to pass therethrough and input the driving signal to the input terminal when the input terminal and the driving signal source are connected;

a detection circuit that detects a voltage of the input terminals when being connected to the input terminals; and a plurality of detection switches that correspond to the actuators, respectively, and connect or disconnect the input terminals of the actuators and the detection circuit on the basis of the drive switch control signals for the actuators or the driving signals passed through the drive switches corresponding to the actuators.

2. The ink jet apparatus according to claim 1, further comprising:

delay circuits that correspond to each of the actuators, and delay and output the drive switch control signals for the actuators or the driving signals passed through the drive switches, wherein the detection switches connect or disconnect the input terminals and the detection circuit according to the drive switch control signals or the driving signals output from the delay circuits.

3. The ink jet apparatus according to claim 2, wherein the delay circuit are latch circuits that latch and output the drive switch control signals for the actuators or the driving signals passed through the drive switches corresponding to the actuators.

4. The ink jet apparatus according to claim 2, wherein the delay circuits are capacitors that store and output the drive switch control signals for the actuators or the driving signals passed through the drive switches corresponding to the actuators.

5. The ink jet apparatus according to claim 1, wherein each of the detection switches comprises a transistor that amplifies and outputs the voltage of the corresponding input terminal.

6. The ink jet apparatus according to claim 1, wherein the plurality of actuators are divided into a plurality of groups, and wherein the detection circuit is provided for every group, and the detection switches connect the actuators and the detection circuit for the groups into which the actuators are divided.

7. The ink jet apparatus according to claim 1, further comprising:

a number-of-times-of-driving detection circuit that detects whether or not the number of actuators to be simultaneously driven is a predetermined number, wherein the detection circuit determines the state of a nozzles including the actuators on a basis of the voltage of the input terminals, when the number is the predetermined number.

8. The ink jet apparatus according to claim 7, wherein the predetermined number is 1.

9. A method for controlling an ink jet apparatus that includes:

a plurality of actuators that correspond to a plurality of discharge ports, respectively, and discharge a liquid from the discharge ports according to driving signals input to input terminals;

a driving signal source that outputs the driving signals;

a driving selector that outputs a drive switch control signal for an actuator to be driven among the plurality of actuators;

a detection circuit that detects a voltage of the input terminals when being connected to the input terminals;

a plurality of drive switches that correspond to the actuators, respectively, connect or disconnect the input terminals of the actuators and the driving signal source, and allow the driving signals to pass therethrough and input the driving signals to the input terminals when the input terminals and the driving signal source are connected; and a plurality of detection switches that correspond to the actuators, respectively, and connect or disconnect the input terminals of the actuators and the detection circuit, wherein each of the drive switches is made to connect or disconnect the input terminal of one of the actuators and the driving signal source according to the drive switch control signal for the actuator, and each of the detection switches is made to connect or disconnect the input terminal of one of the actuators and the detection circuit on a basis of the drive switch control signal for the actuator or the driving signal passed through the drive switch corresponding to the actuator.

* * * * *